US006802581B2

(12) United States Patent
Hasseler et al.

(10) Patent No.: US 6,802,581 B2
(45) Date of Patent: Oct. 12, 2004

(54) METHOD, PROGRAM PRODUCT AND SYSTEM FOR INK MANAGEMENT CONTROL

(75) Inventors: Klevin Hasseler, Murrieta, CA (US); Yaguang Liu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 139 days.

(21) Appl. No.: 10/209,614

(22) Filed: Jul. 30, 2002

(65) Prior Publication Data

US 2004/0021711 A1 Feb. 5, 2004

(51) Int. Cl.[7] ..... B41J 2/195; B41J 29/38
(52) U.S. Cl. ..... 347/7; 347/19
(58) Field of Search ..... 347/7, 14, 19; 47/14

(56) References Cited

U.S. PATENT DOCUMENTS 5,583,545 A * 12/1996 Pawlowski et al. ..... 347/7
6,322,182 B1 * 11/2001 Lin et al. ..... 347/7
6,672,695 B1 * 1/2004 Naka et al. ..... 347/7
6,758,541 B2 * 7/2004 Hashimoto ..... 347/5
2002/0118236 A1 * 8/2002 Uetsuki ..... 347/7
2003/0058297 A1 * 3/2003 Sarula ..... 347/19

FOREIGN PATENT DOCUMENTS

| | | |
|---|---|---|
| EP | 0 443 245 | 8/1991 |
| EP | 1 080 930 | 3/2001 |
| EP | 1 238 811 | 9/2002 |
| WO | WO 90/00974 | 2/1990 |

* cited by examiner

*Primary Examiner*—Stephen D. Meier
*Assistant Examiner*—Alfred Dudding

(57) ABSTRACT

Disclosed are systems and methods for ink management utilizing a master controller, which receives configuration information from one or more ink pens, reservoirs, printheads, or ink level measurement devices. The controller receives master controller commands; reads data from system sensors; reads and writes data to and from smart chips associated with elements in the system and a non-volatile memory associated with an ink management controller; and independently takes action in response to data from a smart chip or sensor.

37 Claims, 5 Drawing Sheets

METHOD, PROGRAM PRODUCT AND SYSTEM FOR INK MANAGEMENT CONTROL

FIELD OF THE INVENTION

The present invention relates generally to printing operations, and more particularly to ink management control in such printing operations.

BACKGROUND OF THE INVENTION

In setting up a printing system, any number of printheads of different types and manufacturers can be used together or separately to meet a variety of different printing applications. Although each application may use the printheads differently, they will have in common the delivery of the ink. One problem to be solved in the prior art is to keep the ink delivery aspects of the printing system modular and scalable so that ink delivery does not have to be redeveloped every time a new application is created.

SUMMARY OF THE INVENTION

The present invention comprises, in one embodiment, a method for ink management in an ink management system for use with a master controller, comprising: receiving configuration information for one or more of ink pens, reservoirs, printheads, and ink level measurement method designation; receiving master controller commands; reading data from system sensors and reading and writing data to and from smart chips associated with elements in the system and a non-volatile memory associated with an ink management controller in the ink management system; and independently taking an action in response to data from one or more of a smart chip or a sensor.

The present invention comprises in a further embodiment, an ink management system for use with a host, comprising: a different smart chip associated with each one of a plurality of reservoirs or printheads; non-volatile memory associated with the ink management system; and a processor for receiving configuration information for one or more of ink pens, reservoirs, printheads, and an ink level measurement method designation and for receiving master controller commands, and reading data from sensors and reading and writing data to and from the smart chips and the non-volatile memory in the ink management system, and processing data from at least one smart chip or sensor, determining if the data meets a criteria, and if the data meets the criteria then independently taking an action.

In a further embodiment of the present invention, an ink management system is provided for use with a master controller, comprising: means for receiving configuration information for one or more of ink pens, reservoirs, printheads, and ink level measurement method designation; means for receiving master controller commands; means for reading data from system sensors and reading and writing data to and from smart chips associated with elements in the system a non-volatile memory associated with an ink management controller in the ink management system; and means for independently taking an action in response to data from one or more of a smart chip or a sensor.

DETAILED DESCRIPTION OF EMBODIMENTS OF THE PRESENT INVENTION

Figure 1:
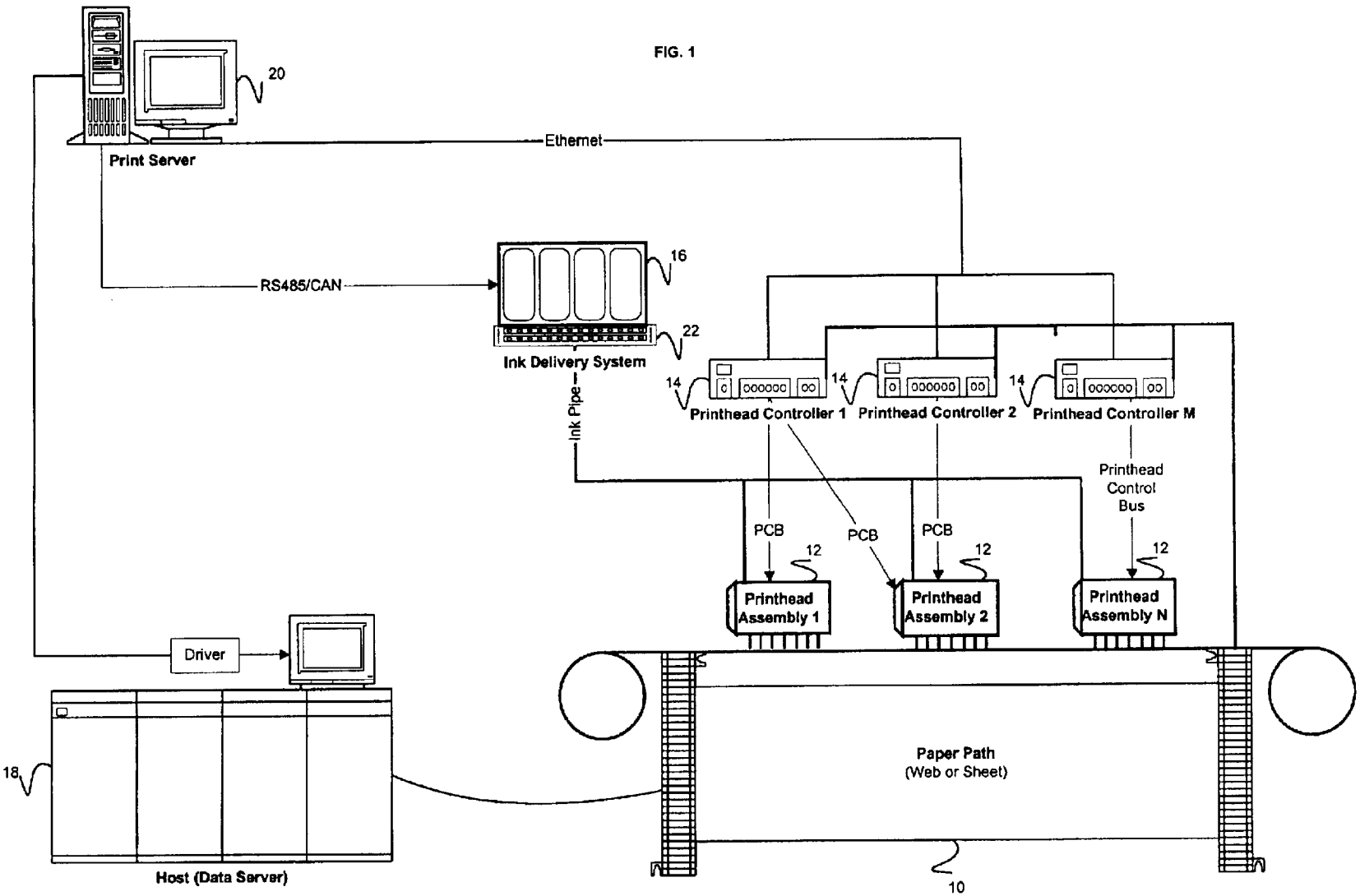
FIG. 1 is a schematic block diagram of an overall printing system in accordance with the present invention.

Referring now to FIG. 1, there is shown an overall system embodiment of the present invention. FIG. 1 includes a paper path assembly 10 with a plurality of printhead assemblies 12 disposed in relation to the paper or web in the paper path of assembly 10 to print images thereon. The printhead assemblies 12 are controlled by associated printhead controllers 14. An ink delivery system 16 comprising a plurality of reservoirs or cartridges supply ink directly to the printhead assemblies 12. In one embodiment, each ink reservoir or cartridge includes a smart chip such as a readable/writeable EEPROM for storing cartridge technical data, ink level detection data, and other pertinent data. Additionally, the embodiment may optionally include a smart chip on each of the printheads in the printhead assemblies 12 for storing calibration and other information about each of the pens in the printhead as well as other desired information.

The present invention further includes an ink management controller 22 for providing ink management. The ink management controller 22 is shown in the embodiment of FIG. 1 disposed with the ink cartridges/reservoirs 16, and shown in more detail in FIG. 2. The ink management controller 22 obtains data from ink level sensors in each of the ink reservoirs, obtains data from one or more ink detection sensors in each reservoir, as well as drop count measurements for each of the reservoirs. The ink management controller 22 also provides pump control.

The system of FIG. 1 further includes a host data server 18. The host data server may perform a variety of functions typical to such servers, including processing data, spooling, sending data, sending job commands, and monitoring overall system operations.

The system further includes a print server or formator 20 for providing overall job control, including print control, ink management, and data delivery. The print server 20 provides the interface for the user and allows either local or remote control of the system. The print server 20 in one embodiment would have a central processor for managing all concurrent tasks and control of data flow. The print server may also include a print manager module which would schedule and send print data to PHC boxes, as well as start, stop, and monitor print jobs. Additionally, the print server may include an ink manager module that would operate to manage the ink delivery system (IDS) of the printer and report the IDS status to the controller. Additionally, the print server 20 may include a graphical user interface (GUI) to allow a user to administer and configure the print server and to display the status of the various subsystems. The print server 20 may also include an HPC pipeline module to convert the received print data into specific roster image format data. In some embodiments, the data server 18 and the print server 20 may be conveniently combined.

The printheads in the printhead assemblies 12 in one embodiment might include a collection of sensors for pen stalls, out of ink sensing, leakage sensing, and TOF detection. Each of the printhead assemblies in one embodiment would include a communication module for providing this information to an ink management controller to be discussed below. Alternatively, the ink management controller may query the sensors, or appropriate data fields in a smart chip associated with a given printhead. By way of example but not by way of limitation, the printhead assemblies may be implemented by Hewlett-Packard printhead assembly Model Nos. C8828a, C8829a, C8830a, and C8831a HP 80 printheads. These printheads are four-color drop-on-demand, thermal inkjet systems for fast printing at near-photographic quality.

The ink reservoirs or cartridges 16 may be implemented by way of example and not by way of limitation, by HP Model Nos. C8832a, C8833a, C8834a, and C8835a HP 80 ink cartridges. These ink cartridges include smart chips on the ink cartridges.

By way of example but not by way of limitation, the smart chips that may be utilized on the ink cartridges 16 and on the printheads in the printhead assemblies 12 may be four-pin non-volatile data storage devices. In one embodiment of this smart chip, there may 72 addressable bytes of memory organized into three areas comprising write once, read only, and rewritable. Data is accessed over a two wire serial interface $I^2$ C like bus with a bi-directional serial data line and a serial clock line. Interconnect pads provide access to data, clock, voltage and a ground line. The smart chips may contain a variety of information including product technical information, calibration data, printing parameters, manufacturing date, servicing information, and other pertinent information. Current models of the smart chip have a clock frequency of 100 KHz and an operating voltage of 3.0 to 5.5V. Accordingly, each smart chip carries information recording a variety of specific data about an individual replaceable or nonreplaceable printhead, ink cartridge or other device associated therewith. An embodiment of the smart chip is disclosed in U.S. Pat. No. 5,699,091.

In one embodiment of the printheads, 512 useable nozzles are positioned for 600 per inch spacing, a 12 kHz firing frequency, and a 33 PL black drop volume, and a 12 PL color drop volume.

Figure 2:
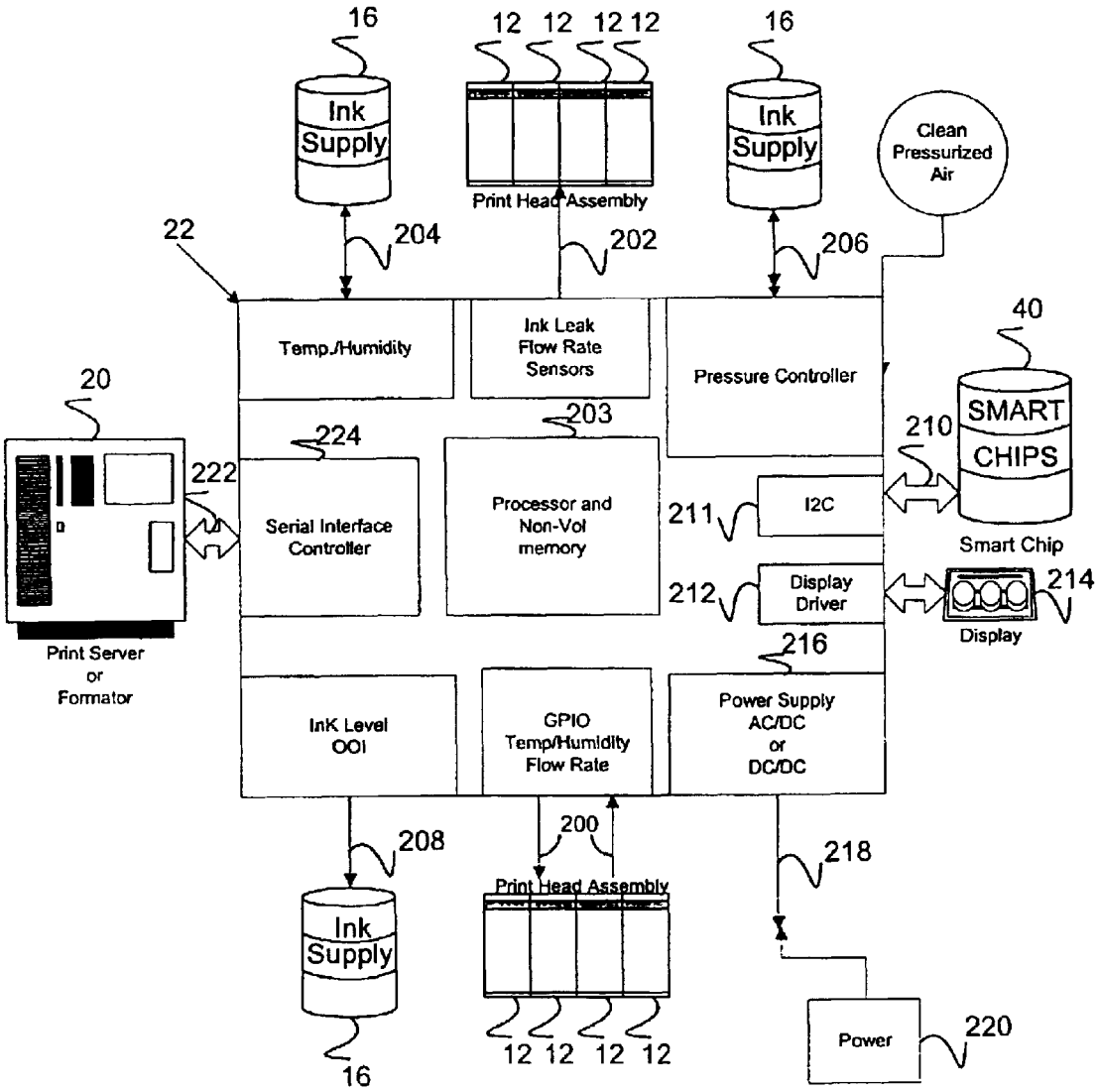
FIG. 2 is a schematic block diagram of an embodiment of an ink management control system of the present invention.

Referring now to FIG. 2, an embodiment of the ink management controller 22 is shown in schematic format. The ink management controller 22 includes a processor and non-volatile memory 203 to retain data during power losses and for other purposes, a general purpose I/O communication module (not shown) for communicating with the printhead assemblies 12 or the print server formator 20 or other convenient device to thereby obtain data on temperature and humidity, flowrate of ink, drop count to the individual pens, and other pertinent information. This communication is indicated schematically by the arrows 200. Additionally, the ink management controller 22 is shown communicating with each printhead assembly 12 or the print server/formator 20 or other device to obtain ink leak information, flow rate, and other sensor information, as indicated by line 202. Likewise, the ink management controller 22 has a communication interface to each of the ink reservoirs 16 to obtain temperature and humidity information, as indicated by line 204. Additionally, the ink management controller 22 obtains pressure information from sensors in each of the ink reservoirs 16 as indicated schematically by line 206. Additionally, the ink management controller 22 obtains ink level information and out of ink sensing from appropriate sensors in each of the ink reservoirs 16, as indicated schematically by line 208.

Data on ink level, out of ink, drop count, and other pertinent sensor information for a given ink reservoir 16 is written to an associated smart chip 40 for that ink reservoir as indicated by the data flow line 210. Block 40 also is intended to schematically represent smart chips for the individual printheads in the printhead assemblies 12. Accordingly, the communication line 210 also indicates reading and writing to the smart chips in the respective printheads in the system. By way of example but not by way of limitation, a communication protocol such as a $I^2C$ may be utilized to implement this communication interface, and is indicated by the $I^2C$ module 211 in the figure.

The ink management controller 22 may also include a display driver 212 for driving a display 214. Additionally, the ink management controller 22 would include an appropriate power supply 216 connected via a power line 218 to a power source 220. The print server or formator 20 is shown connected via a communication bus 222 to a serial interface block 224 in the ink management controller 22. By way of example but not by way of limitation, an embodiment of the serial interface controller could be implemented using a RS 232 controller.

Figure 5:
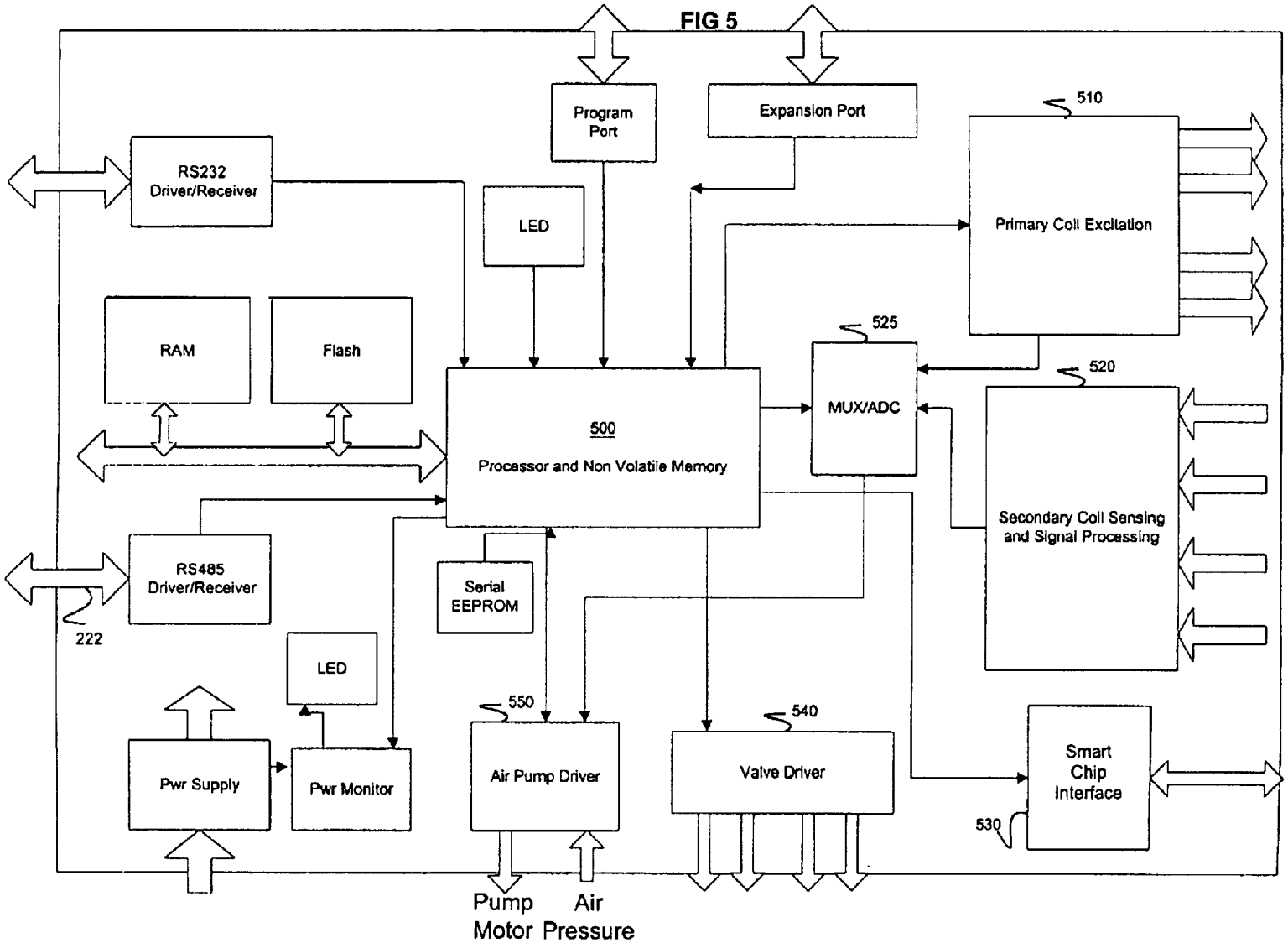
FIG. 5 is a schematic diagram of an embodiment of an ink management control system of the present invention.

A specific embodiment of an ink management controller 22 is shown in FIG. 5. Note that the processor and non-volatile memory 500 provides a primary coil excitation 510 to the ink cartridges and receives data from the ink cartridges via the secondary coil sensing and signal processing 520. The MUX/ADC 525 selects and communicates with ink cartridges on a multiplex basis. The smart chip interface 530 provides communication with the smart chips. The valve driver 540 drives the solenoid valves to open and close ink flow to the ink cartridges. The air pump driver 550 controls air pressure levels to the ink cartridges.

Figure 3:
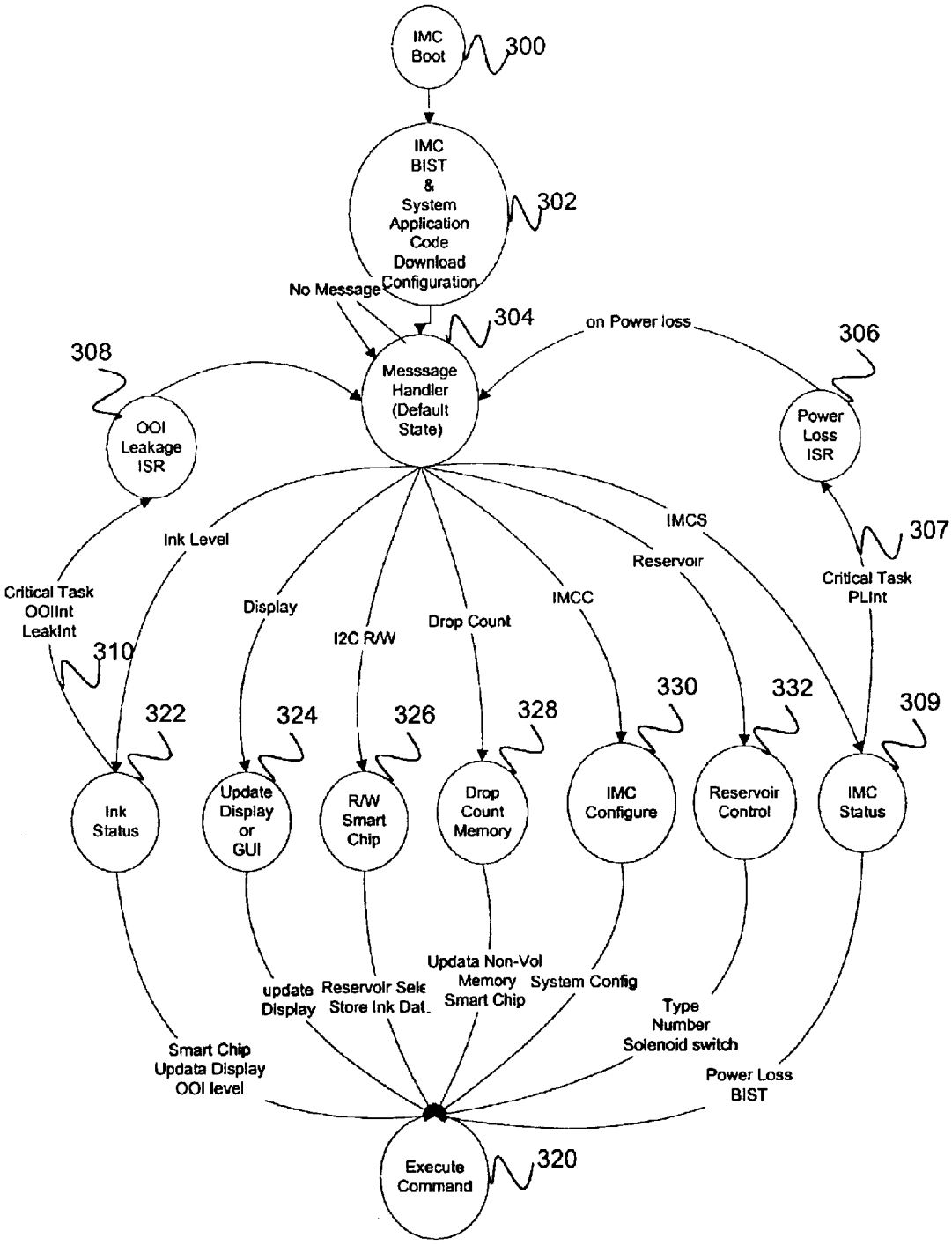
FIG. 3 is a state diagram for an embodiment of an ink management control system of the present invention.

Referring now to FIG. 3, a state diagram for an embodiment of the ink management controller 22 is shown. The state diagram includes an ink management controller boot state 300 and an ink management controller BIST and system application code download configuration state 302. This configuration download 302 may be from the print server 20 and includes information for one or more of ink pens, reservoirs, printheads, and ink level measurement method designations for the system. In one embodiment, the configuration information for the system would include a listing of all of the ink pens, reservoirs, printheads in the system, and the ink level measurement methods to be used for those items.

FIG. 3 further includes a message handler (default state) 304 that receives and processes communications from a master controller such as the print server 20. The message handler state 304 includes a line for power loss to a Power Loss ISR state 306. The Critical Task PLINT line 307 from state 306 is an indication that an interrupt signal may be independently generated and sent via the IMC Status state 309 to the print server 20. Note that the IMC Status state 309 is one of the states that reads the various ink level and other sensors.

Likewise, the line from the Message Handler state 304 to the OOI leakage ISR state 308 is an out of ink or leak state and a line 310 designated Critical Task OOIINT Leak INT to the Ink Status state 322 is an indication that in one embodiment an interrupt would be independently generated and sent to the print server 20. Note that the Ink Status state 322 is one of the states that reads the various ink level and other sensors.

Various commands may be executed from the Execute Command state 320. These commands include an Ink Status command 322 in order to obtain ink level data. Additionally the execute command state 320 may execute an Update Display or GUI state 324 to update the data field in a display. Additionally, the execute state 320 may execute a read/write R/W Smart Chip command 326 to write data such as an ink level for a newly inserted reservoir or may write other pertinent information into the smart chips, or may read data from various smart chips.

Additionally, the execute command state 320 optionally may execute a Drop Count Memory command 328 to update the drop count data in non-volatile memory and in various smart chips. The execute command state 320 also may execute an IMC Configure command 330 for sending system configuration information of the number of ink pens, reservoirs, printheads, and an ink measurement method designation to the ink management controller 22. The execute command state 320 further may execute a Reservoir Control command 332 for sending the type and number of solenoid switches in the system. The solenoid switches are used to turn ink supplies on or off in a system with multiple ink reservoirs. For example a gang of four ink supplies can be turned on one at a time as they empty. In this way an empty ink reservoir can be replaced while another ink reservoir in the system is being used. If the system is designed to use drop counting, this feature allows the accumulation of the drops to be attributed to a particular ink reservoir. This is useful if more than one ink reservoir is being used at the same time. Additionally, the execute command state may execute an IMC Status command 309 to obtain IMCS information.

Figure 4:
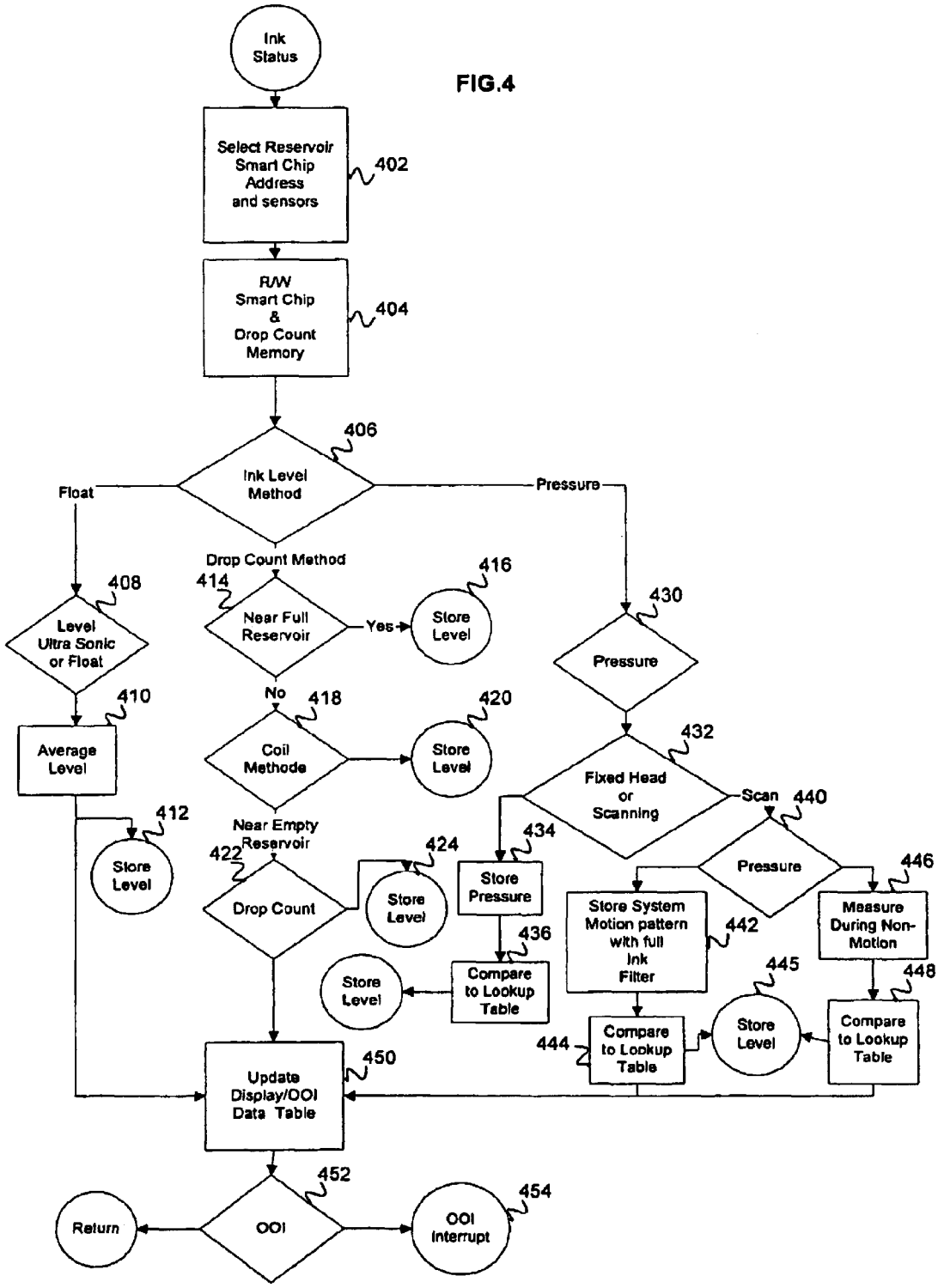
FIG. 4 is a schematic flowchart of an embodiment of an ink status control algorithm that may be utilized in the present invention.

Referring now to FIG. 4, there is shown an example of an algorithm that may be run on the processor 203 of the ink management controller 22. This algorithm is indicated by the Ink Status state 322 in the state diagram of FIG. 3. The first step as indicated by block 402 in the figure is to select an individual reservoir, a smart chip address associated with that reservoir, and the sensors associated with that reservoir. In one embodiment block, 402 may initially poll various smart chips and sensors associated with the reservoirs, printheads and any other appropriate equipment. Block 404 indicates a reading/writing operation to the selected smart chip. This reading/writing operation could include a reading of the drop count data field for a smart chip associated with a reservoir, and optionally a reading from a smart chip associated with a printhead.

In block 406 an ink level measurement method is determined. This determination of ink level measurement is obtained from the configuration information download from the print server 20. If a float method of measurement is designated, then the algorithm implements blocks 408, 410, and 412. Likewise, if a drop count method is selected, then the algorithm will utilize blocks 414, 416, 418, 420, 422, and 424. Likewise, if a pressure method of ink measurement is selected, then the algorithm will utilize blocks 430–448. It should be noted that FIG. 4 is an example embodiment of one particular implementation of these methods of ink measurement. There are a variety of different ink measurements available and algorithms for implementing those measurements. By way of example but not by way of limitation, see U.S. Pat. Nos. 6,367,919; 6,312,075; 6,302,503; 6,247,775; 6,164,743; 6,151,039; 5,793,387; 5,788,388; 5,682,183; 5,635,965; 5,583,545; and 5,574,484 for example ink measurement methods. The present invention is not limited to any one or any particular combination of ink measurement methods. Regardless of the ink measurement method or methods selected, various updating operations may be performed both for the display GUI 214, the appropriate ink measurement fields in the various smart chips, and appropriate ink measurement field in the non-volatile memory in the ink management controller 22, as well as various data tables as indicated by block 450. The algorithm of FIG. 4 further includes an out of ink determination 452. If an out of ink indication is present, then an OOI Interrupt 454 is generated for the print server 20. Likewise, if there is no out of ink indication, then the algorithm returns.

An advantage of one embodiment of the present invention is the provision of an ability to control management of ink from storage reservoirs from any vendor to printheads or printhead assemblies from any other vendor in any configuration. In one embodiment, a common serial interface to a print job controller or formator 20 may be provided. This interface might for example be a CAN or RS232, or RS485, Ethernet TCP/IP or other convenient interface. An embodiment of the invention may use a slave ink management controller 22 operated by a master controller or server 20. The ink management controller 22 of this embodiment may be a stand-alone system supporting DC/DC or AC/DC power supply to allow co-location from a print format or print server. Embodiments of the invention may conveniently utilize smart chip technology for identification of ink type, amount and ink level remaining in an ink storage container. In one embodiment the ink management controller 22 can read and write to any of the data fields within these smart chips. Pressure may be controlled via a DC motor pump or via control of an external pressure regulator. Note that the pressure in ink lines can be monitored and regulated by controlling air pressure going into the ink reservoir. This may be a function of the controller. Alternatively, the air pressure going into the ink reservoir may be regulated. This regulation can be accomplished by the controller or externally. Note that air pressure regulation is an optional feature. In this regard, ink can be drawn out of the ink reservoir by gravity or the natural sucking action of the pens.

Embodiments of the invention may include a non-volatile memory in the ink management controller 22 in order to maintain drop counts, label status, and other pertinent information during power loss. The actual drop count for each pen may be provided by a formatter PCA. The design may maintain a running total count of the drops for each store container. The amount of ink consumed is stored in a field of the smart chip device mounted on the reservoir and in non-volatile memory. The printer server 20 by means of a user interface may also indicate ink storage reservoirs and an amount of ink therein. The non-volatile memory for the ink management controller may also contain calibration information for the reservoir ink level sensing coils.

Various embodiments of the invention may include also an ink leak detector, which might include liquid bubble sensors, resistive wetness detectors, optical methods, or pressure loss detection of spillage. Embodiments of the invention may also include ink degas vacuum controllers. Embodiments of the present invention may use various combinations of an ink level detector using drop count, pressure, electrical coil proximity detectors, reservoir weight measurement, ultrasonic surface level detectors, and any other convenient measuring sensor or technique to ensure accuracy and redundant detection for high reliability of the system and to provide data for diagnostic algorithms. The different detectors will allow usage of a wide range of vendor reservoir sizes in the system.

Embodiments of the invention may include optical, flow rate liquid out-of-ink detectors for out-of-ink events. Embodiments of the invention may also conveniently include ink reservoir and printhead assembly temperature and humidity detection. Embodiments of the invention may include ink reservoir flow selection switch control for selecting an empty reservoir out of the ink flow without introduction of bubbles or flow restriction or loss of flow. The ink management controller in some embodiments also alerts users to fill the ink reservoir or replace the ink reservoir.

Embodiments of the ink management controller may also include a display of control ink status, ink level, reservoir selection, ink type and color, and low ink warning. The display information may be delivered as a GUI via a serial host interface or control of dedicated LCD or LED display, for example. Embodiments of the invention may facilitate downloads of configuration information from a host, monitor operating system boots from internal CPU memory, and perform built-in self-test (BIST) after an application is downloaded.

Accordingly, some embodiments of the present invention may poll a predetermined list of memory addresses to determine smart chips and sensors in a system.

Other embodiments of the present invention may include measuring ink in a reservoir using at least two different methods, detecting if there is an inconsistency in the measurements, and sending a status update to a graphical user interface. The detection of the inconsistency in the measurement might, for example, be implemented by determining if a difference between these measurements exceeds a predetermined value.

Other embodiments of the present invention may permit a type of ink to be determined for any detected inconsistency relative to a predetermined ink type, and a status message for a GUI selected based on the determined type.

Further embodiments of the present invention may include a step of sending status display information to a GUI.

Further embodiments of the present invention might initiate an independent action in response to an out-of-ink indication for a reservoir. Other embodiments of the present invention might initiate an independent action taken in response to a loss of power indication. Other embodiments of the present invention might initiate an independent action in response to a leakage indication. Other embodiments of the present invention might initiate an independent action to shut off an ink pump.

Other embodiments of the present invention might store a drop count for each of a plurality of reservoirs and reservoir types in non-volatile memory for the ink management controller. Other embodiments of the present invention may store ink color information in the non-volatile memory. Other embodiments of the present invention might store calibration information for at least one pen in non-volatile memory.

Some embodiments of the present invention may include in the received configuration information a combination of different types of ink level measurement designations. By way of example, such a combination of ink level measurements may comprise two or more of drop count, pressure, electrical coil proximity detectors, reservoir weight measurement, and ultrasonic surface level detectors. Further embodiments of the present invention may receive data for ink level measurement from three or more of drop count, pressure, electrical coil proximity detectors, reservoir weight measurement, and ultrasonic surface level detectors.

Other embodiments of the invention may comprise polling the system to determine at least one of smart chips and sensors in the system; comparing the smart chips and sensors determined to be in the system in the polling step to smart chips and sensors provided in the configuration information; and sending a signal reporting discrepancies.

Other embodiments of the present invention may, after receiving configuration information, look in non-volatile memory associated with the system for any past faults and send a signal reporting the same. Other embodiments of the present invention may, after receiving configuration information, poll the smart chips for past faults and send a signal reporting the same.

Other embodiments of the present invention prevent selected ink management system fields from being accessed by a host via appropriate programming.

Other embodiments of the present invention may receive in the downloaded configuration information one or more algorithms for determining actions to take based on data from the various sensors in the system.

Other embodiments of the present invention may independently issue a system interrupt to the host based on data from one or more of the sensors.

Various embodiments of the present invention may be used with reservoirs and printheads from a wide variety of different manufacturers and using different configurations and measurement tools and sensors. Some embodiments of the present invention are particularly advantageous for diagnosing and troubleshooting problems within the ink management system. By way of example but not by way of limitation, if one ink level detector indicates half full, while a second ink level detector indicates empty, then an example diagnosis of the problem may be a pinched line.

Other embodiments of the present invention may be utilized to indicate that a warranty for an ink reservoir has been voided based on some action taken relative to the reservoir. By way of example, if a pressure sensor associated with a given ink reservoir indicated a full reservoir, but an out of ink flag had been set in the smart chip associated with that reservoir due to an earlier out of ink detection, then an indicator such as a flag could be set in the system that the warranty was void for that reservoir because it had been refilled without authorization.

In other embodiments of the present invention, when a predetermined ink must be used for a particular application, such as check printing, then various safeguards could be set up to compare the ink in the reservoir to a predetermined value. Likewise, when a sensor for that reservoir indicated that the reservoir was empty, then a flag could be set and information could be sent back to an appropriate GUI alerting a user that only a special ink may be used for that reservoir.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method for ink management in an ink management system for use with a master controller, comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system; and independently of the master controller taking an action in response to fault indicative data from one or more of a smart chip or a sensor.

2. The method as defined in claim 1, wherein the receiving configuration information step comprises querying a predetermined list of memory addresses to determine the smart chips and sensors in the system.

3. The method as defined in claim 1, further comprising measuring ink in a reservoir using at least two different methods; detecting if there is an inconsistency in the measurements; and sending a status update to a GUI.

4. The method as defined in claim 1, wherein an ink type is determined and compared to a predetermined ink type to detect an inconsistency; and a status message is selected based on the comparison.

5. The method as defined in claim 1, further comprising: sending status display information to a GUI.

6. The method as defined in claim 1, wherein the independent action taken is in response to an out-of-ink indication for a reservoir.

7. The method as defined in claim 1, wherein the independent action taken is in response to a loss of power indication.

8. The method as defined in claim 1, wherein the independent action taken is in response to the data indicating that ink is leaking from at least one of the ink pens.

9. The method as defined in claim 1, wherein the independent action taken is to shut off an ink pump.

10. The method as defined in claim 1, wherein the information stored in non-volatile memory is a drop count for each of a plurality of reservoirs and reservoir types.

11. The method as defined in claim 1, wherein the information stored in non-volatile memory is an ink color.

12. The method as defined in claim 1, wherein the information stored in non-volatile memory is calibration information for at least one pen.

13. The method as defined in claim 1, wherein the ink level measurement designation comprises a combination of different types of ink level measurements.

14. The method as defined in claim 13, wherein the combination of ink level measurements comprise two or more of a drop count method, pressure method, electrical coil proximity method, reservoir weight measurement, and ultrasonic surface level method.

15. The method as defined in claim 1, wherein the configuration information includes an algorithm for determining actions to take based on data from the sensors.

16. The method as defined in claim 1, further comprising independently issuing a system interrupt to the host based on data from one or more of the sensors.

17. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor;

wherein the ink level measurement designation comprises a combination of different types of ink level measurements, and wherein the combination of ink level measurements methods may receive data for ink level measurement from three or more of drop count detectors, pressure detectors, electrical coil proximity detectors, reservoir weight measurement, and ultrasonic surface level detectors.

18. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor;

polling the system to determine at least one of smart chips and sensors in the system;

comparing the smart chips and sensors determined to be in the system in the polling step to smart chips and sensors provided in the configuration information; and sending a signal reporting a discrepancy.

19. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor; and after receiving configuration information looking in the non-volatile memory associated with the system for any past fault and sending a signal reporting the same.

20. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor; and after receiving configuration information polling the smart chips for a past fault and sending a signal reporting the same.

21. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor; and wherein selected data from the ink management system is prevented from being accessed by a host.

22. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor; and wherein the ink management system includes multiple reservoirs of the same ink type, and further comprising controlling the multiple reservoirs to supply ink from only one of the multiple reservoirs of the same ink type at a time.

23. The system as defined in claim 22, further comprising: a GUI for displaying ink status information.

24. The system as defined in claim 22, wherein the ink level measurement method designation is a combination of different types of ink level measurements.

25. The system as defined in claim 24, wherein the combination of ink level measurements comprise two or more of a drop count method, pressure method, electrical coil proximity method, reservoir weight measurement, and ultrasonic surface level method.

26. A method for ink management in an ink management system for use with a master controller comprising:

receiving configuration information for one or more of ink pens, reservoirs, printheads, and ink level measurement method designation;

receiving master controller commands;

reading data from system sensors and reading and writing data to and from smart chips associated with elements in the system and a non-volatile memory associated with an ink management controller in the ink management system;

independently taking an action in response to data from one or more of a smart chip or a sensor; and displaying information on the ink management system measurement or a status on a display physically located on a slave controller for the ink management system.

27. An ink management system for use with a host, comprising:

a different smart chip associated with each one of a plurality of reservoirs or printheads;

non-volatile memory associated with the ink management system; and a processor for receiving configuration information for one or more of ink pens, reservoirs, printheads, and ink level measurement method designation and for receiving master controller commands from a master controller, and reading data from sensors and reading and writing data to and from the smart chips and the non-volatile memory in the ink management system, and processing data from at least one smart chip or sensor, determining if the data meets a fault indicative criteria, and if the data meets the fault indicative criteria then independently taking an action independently of the master controller.

28. The system as defined in claim 27, further comprising a querying component for querying a predetermined list of memory addresses to determine the smart chips and sensors in the system.

29. The system as defined in claim 27, wherein the processor receives ink measurements for ink in a reservoir using at least two different methods, detects if there is an inconsistency in the measurements; and sends a status update to a GUI.

30. The system as defined in claim 27, wherein the processor determines an ink type and compares the detected ink type to a predetermined ink type to detect an inconsistency; and selects a status message based on the comparison.

31. The system as defined in claim 27, wherein the processor independently issues a system interrupt to the host based on data from one or more of the sensors.

32. The system as defined in claim 27, further comprising a graphical user interface disposed on the ink management controller for displaying information on an ink management system measurement or a status.

33. An ink management system for use with a host, comprising:

a different smart chip associated with each one of a plurality of reservoirs or printheads;

non-volatile memory associated with the ink management system; and a processor for receiving configuration information for one or more of ink pens, reservoirs, printheads, and ink level measurement method designation and for receiving master controller commands, and reading data from sensors and reading and writing data to and from the smart chips and the non-volatile memory in the ink management system, and processing data from at least one smart chip or sensor, determining if the data meets a criteria, and if the data meets the criteria then independently taking an action, and wherein the processor initiates a signal to poll the system to determine at least one of smart chips and sensors in the system, compares the smart chips and sensors determined to be in the system in the polling step to smart chips and sensors provided in the configuration information, and initiates a signal reporting a discrepancy.

34. An ink management system for use with a host, comprising:

a different smart chip associated with each one of a plurality of reservoirs or printheads;

non-volatile memory associated with the ink management system; and a processor for receiving configuration information for one or more of ink pens, reservoirs, printheads, and ink level measurement method designation and for receiving master controller commands, and reading data from sensors and reading and writing data to and from the smart chips and the non-volatile memory in the ink management system, and processing data from at least one smart chip or sensor, determining if the data meets a criteria, and if the data meets the criteria then independently taking an action, and wherein the processor after receiving configuration information looks in the non-volatile memory for any past fault and initiates a signal reporting the same.

35. An ink management system for use with a host, comprising:

a different smart chip associated with each one of a plurality of reservoirs or printheads;

non-volatile memory associated with the ink management system; and a processor for receiving configuration information for one or more of ink pens, reservoirs, printheads, and ink level measurement method designation and for receiving master controller commands, and reading data from sensors and reading and writing data to and from the smart chips and the non-volatile memory in the ink management system, and processing data from at least one smart chip or sensor, determining if the data meets a criteria, and if the data meets the criteria then independently taking an action, and wherein the processor after receiving configuration information polls the smart chips for a past fault and initiates a signal reporting the same.

36. An ink management system for use with a host, comprising:

a different smart chip associated with each one of a plurality of reservoirs or printheads;

non-volatile memory associated with the ink management system; and a processor for receiving configuration information for one or more of ink pens, reservoirs, printheads, and ink level measurement method designation and for receiving master controller commands, and reading data from sensors and reading and writing data to and from the smart chips and the non-volatile memory in the ink management system, and processing data from at least one smart chip or sensor, determining if the data meets a criteria, and if the data meets the criteria then independently taking an action, and wherein processor includes a program that prevents selected data from the ink management system from being accessed by a host.

37. An ink management system for use with a master controller, comprising:

means for receiving configuration information for one or more of ink pens, reservoirs, printheads, and ink level measurement method designation;

means for receiving master controller commands;

means for reading data from system sensors and reading and writing data to and from smart chips associated with elements in the system a non-volatile memory associated with an ink management controller in the ink management system; and means for taking an action independently of the master controller in response to fault indicative data from one or more of a smart chip or a sensor.

* * * * *

UNITED STATES PATENT AND TRADEMARK OFFICE

CERTIFICATE OF CORRECTION

PATENT NO. : 6,802,581 B2
DATED : October 12, 2004
INVENTOR(S) : Hasseler et al.

It is certified that error appears in the above-identified patent and that said Letters Patent is hereby corrected as shown below:

Title page,
Item [75], Inventors, delete "Klevin Hasseler," and insert therefor -- Kelvin Hasseler, --.

Signed and Sealed this

Nineteenth Day of April, 2005

JON W. DUDAS
*Director of the United States Patent and Trademark Office*